US012663217B2

(12) United States Patent
Tao et al.

(10) Patent No.: US 12,663,217 B2
(45) Date of Patent: Jun. 23, 2026

(54) TUBE SHEET BUILT-IN TYPE STRUCTURE AND SPIRAL-FLOW TYPE WOUND TUBE HEAT EXCHANGER

(71) Applicant: ZHENHAI PETROCHEMICAL JIANAN ENGINEERING CO., LTD., Zhejiang (CN)

(72) Inventors: Jiang Tao, Zhejiang (CN); Hongliang Ren, Zhejiang (CN); Xingmiao Hu, Zhejiang (CN); Xianan Zhang, Zhejiang (CN); Yuping Li, Zhejiang (CN); Chenchen Ma, Zhejiang (CN); Shuming Lv, Zhejiang (CN)

(73) Assignee: ZHENHAI PETROCHEMICAL JIANAN ENGINEERING CO., LTD., Zhejiang (CN)

( * ) Notice: Subject to any disclaimer, the term of this patent is extended or adjusted under 35 U.S.C. 154(b) by 341 days.

(21) Appl. No.: 18/287,502

(22) PCT Filed: May 14, 2021

(86) PCT No.: PCT/CN2021/093953

§ 371 (c)(1),
(2) Date: Oct. 19, 2023

(87) PCT Pub. No.: WO2022/236838

PCT Pub. Date: Nov. 17, 2022

(65) Prior Publication Data

US 2024/0200876 A1 Jun. 20, 2024

(51) Int. Cl.
*F28D 7/16* (2006.01)

(52) U.S. Cl.
CPC ..... *F28D 7/163* (2013.01)

(58) Field of Classification Search
CPC .... F28D 7/163; F28D 7/00; F28F 9/00; F28F 9/0219; F28F 2009/0285
(Continued)

(56) References Cited

U.S. PATENT DOCUMENTS 2,071,277 A * 2/1937 Barclay ..... F28F 9/0239 165/145
3,244,226 A * 4/1966 Hettrich, Jr. ..... F28F 9/0229 165/135
(Continued)

FOREIGN PATENT DOCUMENTS

CN 201155647 Y 11/2008
CN 202420246 U 9/2012
(Continued)

OTHER PUBLICATIONS

International Search Report from corresponding PCT Application No. PCT/CN2021/093953, dated Feb. 11, 2022.

*Primary Examiner* — Jon T. Schermerhorn, Jr.
(74) *Attorney, Agent, or Firm* — Harness, Dickey & Pierce, P.L.C.

(57) ABSTRACT

The present utility model relates to the technical field of heat exchangers, and disclosed are a tube sheet built-in type structure and a spiral-flow type wound tube heat exchanger. The heat exchanger to which the tube sheet built-in type structure is applicable is provided with a housing, and comprises: a tube sheet provided inside the housing, the tube sheet being not in direct contact with the housing. According to the present utility model, the built-in type tube sheet structure is used, the tube sheet is arranged inside the housing, and the tube sheet is not directly connected to the housing, thereby reducing the longitudinal length of the device and the circumferential outreach dimensions of connecting tubes.

7 Claims, 7 Drawing Sheets

(58) Field of Classification Search
USPC ..... 165/154
See application file for complete search history.

(56) References Cited

U.S. PATENT DOCUMENTS

| | | | | |
|---|---|---|---|---|
| 3,490,521 | A | 1/1970 | Byerley | |
| 4,182,408 | A * | 1/1980 | Laber | F28F 9/0229 29/523 |
| 4,585,053 | A * | 4/1986 | Kaufman | F28D 7/106 165/142 |
| 4,807,698 | A * | 2/1989 | Kohnen | F28F 9/00 165/145 |
| 7,240,724 | B2 * | 7/2007 | Graham | F28F 9/02 165/79 |
| 11,162,709 | B2 * | 11/2021 | Hotton | F24H 1/287 |
| 2005/0034847 | A1 * | 2/2005 | Graham | F28F 9/02 165/158 |
| 2016/0370120 | A1 * | 12/2016 | Ramamoorthy | F28D 7/1607 |

FOREIGN PATENT DOCUMENTS

| | | | |
|---|---|---|---|
| CN | 103657578 | A | 3/2014 |
| CN | 207066191 | U | 3/2018 |
| CN | 209386855 | U | 9/2019 |

* cited by examiner

TUBE SHEET BUILT-IN TYPE STRUCTURE AND SPIRAL-FLOW TYPE WOUND TUBE HEAT EXCHANGER

CROSS-REFERENCE TO RELATED APPLICATIONS

This application is a national phase application of PCT Application No. PCT/CN2021/093953 filed on May 14, 2021. The entire disclosure of the applications identified in this paragraph is incorporated herein by reference.

BACKGROUND OF THE INVENTION

1. Field of the Invention

This utility model relates to the technical field of heat exchangers, and more particularly, to a tube sheet built-in type structure and spiral-flow type wound tube heat exchanger.

2. Description of the Related Art

Heat exchangers have a wide range of applications in various sectors of the national economy. They are one of the most common equipment in industries such as energy, petroleum, chemical, metallurgy, power, light industry, food, and even aerospace. They play an important role in developing secondary energy and achieving heat recovery to save energy dissipation. Currently, wound tube heat exchangers are widely used due to their ability to simultaneously exchange heat with multiple fluids and operate at high pressures. The existing wound tube heat exchangers have tube sheet provided at the upper and lower ends of the housing and fixed to the housing, resulting in a longer overall length of the equipment.

SUMMARY OF THE INVENTION

In view of this, the purpose of the present utility model is to provide a tube sheet built-in type structure and a spiral-flow type wound tube heat exchanger with the tube sheet built-in type structure.

The specific technical solution is as follows:

A tube sheet built-in type structure suitable for a heat exchanger, wherein the heat exchanger comprises a housing, the tube sheet built-in type structure comprising a tube sheet, the tube sheet is provided inside the housing and is not in direct contact with the housing.

The above mentioned tube sheet built-in type structure, wherein the tube sheet comprises a plate-shaped structure and a first annular structure integrally set on the outer edge of the plate-shaped structure, the first annular structure is provided on one side of the plate-shaped structure;

preferably, the tube sheet comprises a second annular structure integrally set in the middle of the plate-shaped structure, the second annular structure is provided on other side of the plate-shaped structure, wherein the interior of the second annular structure forms a groove, a distance between an end of the second annular structure and an bottom of the groove is smaller than a distance between the end of the second annular structure and the plate-shaped structure.

The above-mentioned tube sheet built-in type structure, comprises a tubular structure that passes through the housing, one end of the tubular structure is located outside the housing, while other end of the tubular structure is located inside the housing and connected to the tube sheet.

The above-mentioned tube sheet built-in type structure, wherein the tubular structure comprises a conical portion connected to the tube sheet, a straight portion connected to the conical portion, and a joint connected to the straight portion, an end of the conical portion which has a larger inner diameter is connected to the tube sheet, while an end of the conical portion which has a smaller inner diameter is connected to the straight portion;

preferably, at least a part of the straight portion is located outside the housing, and at least a part of the straight portion is located inside the housing;

preferably, an outer circumference of the straight portion is fixedly connected to the housing.

The above-mentioned tube sheet built-in type structure, wherein the tubular structure comprises a first straight portion connected to the tube sheet, a conical portion connected to the first straight portion, a second straight portion connected to the conical portion, and a joint connected to the second straight portion, wherein an inner diameter of the first straight portion is larger than the inner diameter of the second straight portion;

preferably, at least a part of the first straight portion is located outside the housing, and at least a part of the first straight portion is located inside the housing;

preferably, the outer circumference of the first straight portion is fixedly connected to the housing.

In the above-mentioned tube sheet built-in type structure, wherein the inner diameter of the first straight portion is constant, while the outer diameter of the first straight portion is variable;

preferably, the outer diameter of the middle of the first straight portion is larger than the outer diameter of the two ends of the first straight portion;

preferably, the middle of the outer surface of the first straight portion is connected to the two ends of the outer surface of the first straight portion through a conical portion.

The above-mentioned tube sheet built-in type structure, wherein the heat exchanger has a central cylinder, the tube sheet is perpendicular to an axis of the central cylinder, or the tube sheet is parallel to the axis of the central cylinder, or there is an angle between the tube sheet and the axis of the central cylinder.

The above-mentioned tube sheet in-built type structure, further comprises a supporting rods, wherein one end of the supporting rod is fixedly connected to the tube sheet, and other end of the supporting rod is fixedly arranged.

The above-mentioned tube sheet in-built type structure, further comprises a supporting rod, one end of the supporting rod is rotatably connected to the tube sheet, and other end of the supporting rod is movable only in a first direction parallel to a plane in which the tube sheet is located; or, one end of the supporting rod is rotatably connected to the tube sheet, and other end of the supporting rod is movable only in a second direction orthogonal to a plane in which the tube sheet is located;

preferably, the heat exchanger comprises a central cylinder, wherein the tube sheet is parallel to an axis of the central cylinder, one end of the supporting rod is rotatably connected to the tube sheet, and other end of the supporting rod is slidably connected to the central cylinder, so that the other end of the supporting rod is slidable along the outer surface of the central cylinder.

A spiral-flow type wound tube heat exchanger, comprises one or more of the above-mentioned tube sheet in-built type structures.

A spiral-flow type wound tube heat exchanger, wherein the heat exchanger has a housing, the housing includes a cylinder and heads respectively provided at the upper and lower ends of the cylinder; wherein, it further comprises:

a first tube sheet, located inside the housing and positioned at the upper part of the housing;

a tubular structure, comprising a conical portion connected to the first tube sheet, a straight portion connected to the conical portion, and a joint connected to the straight portion, wherein an end of the conical portion which has a larger inner diameter is connected to the first tube sheet, and an end of the conical portion which has a smaller inner diameter is connected to the straight portion, at least a part of the straight portion is located outside the housing, and at least a part of the straight portion is located inside the housing; the outer circumference of the straight portion is fixedly connected to the upper end head of the cylinder;

a second tube sheet, located at the lower end of the housing, the outer circumference of the second tube sheet is fixedly connected to the head.

The above-mentioned spiral-flow type wound tube heat exchanger, wherein the head of the upper end of the cylinder is provided a housing-side connection, and a side of the cylinder is provided another housing-side connection.

A spiral-flow type wound tube heat exchanger, wherein the heat exchanger comprises a housing, wherein the housing includes a cylinder and head respectively provided at the upper and lower ends of the cylinder; further comprises:

an upper tube sheet, which is located inside the housing and positioned at the upper part of the housing, the upper tube sheet is arranged in a horizontal manner;

an upper tubular structure, the upper tubular structure comprises an upper conical portion connected to the upper tube sheet, an upper straight portion connected to the upper conical portion, and an upper joint connected to the upper straight portion, wherein an end of the upper conical portion which has a larger inner diameter is connected to the upper tube sheet, while an end of the upper conical portion which has a smaller inner diameter is connected to the upper straight portion; at least a part of the upper straight portion is located outside the housing, and at least a part of the upper straight portion is located inside the housing; the outer circumference of the upper straight portion is fixedly connected to the head of the upper end of the cylinder;

a side tube sheet, the side tube sheet is located inside the housing and positioned at the lower part of the housing, the side tube sheet is arranged in a vertical manner;

a side tubular structure, the side tubular structure comprises a side first straight portion connected to the side tube sheet, a side conical portion connected to the side first straight portion, a side second straight portion connected to the side conical portion, and a side joint connected to the side second straight portion, an inner diameter of the side first straight portion is larger than an inner diameter of the side second straight portion; at least a part of the side first straight portion is located outside the cylinder, and at least a part of the side first straight portion is located inside the cylinder; the outer circumference of the side first straight portion is fixedly connected to the cylinder.

The above-mentioned spiral-flow type wound tube heat exchanger, a first housing-side connection is provided on one side of the head of the upper end of the cylinder, and a second housing-side connection is provided in the middle of the head of the lower end of the cylinder.

The above-mentioned spiral-flow type wound tube heat exchanger, a first housing-side connection is provided on one side of the head of the upper end of the cylinder, and a second housing-side connection is provided on one side of the head of the lower end of the cylinder.

The positive effects of the present utility model compared to the prior art are as follows.

(1) The utility model adopts an built-in tube sheet structure, in which the tube sheet is arranged inside the housing and is not directly connected to the housing, thereby reducing the longitudinal length of the device and the circumferential outreach dimensions of the connecting tubes.

(2) The tube sheet structure of the present utility model is connected to the heads of the housing through short section and/or joint, resulting in smaller opening sizes of the heads, which is more conducive to hole reinforcement and material saving.

Reference numbers: 11, tube sheet; 111, plate-shaped structure; 112, first annular structure; 113, second annular structure; 114, plate-shaped structure; 2, housing; 21, cylinder; 22, head; 3, tubular structure; 301, conical portion; 302, straight portion; 303, joint; 311, first straight portion; 312, conical portion; 313, second straight portion; 314, joint; 4, central cylinder; 5, supporting rod; 61, first housing-side connection; 62, second housing-side connection.

DETAILED DESCRIPTION

The following text is further explained with reference to the accompanying drawings and specific embodiments, but it is not intended to limit the present utility model.

Figure 1:
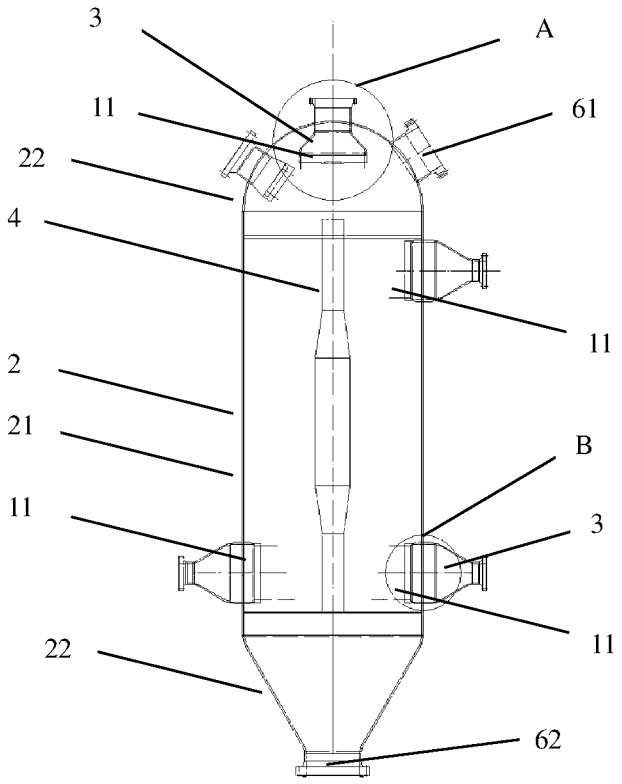
FIG. 1 is a schematic diagram of the tube sheet built-in type structure in the present utility model.
Figure 2:
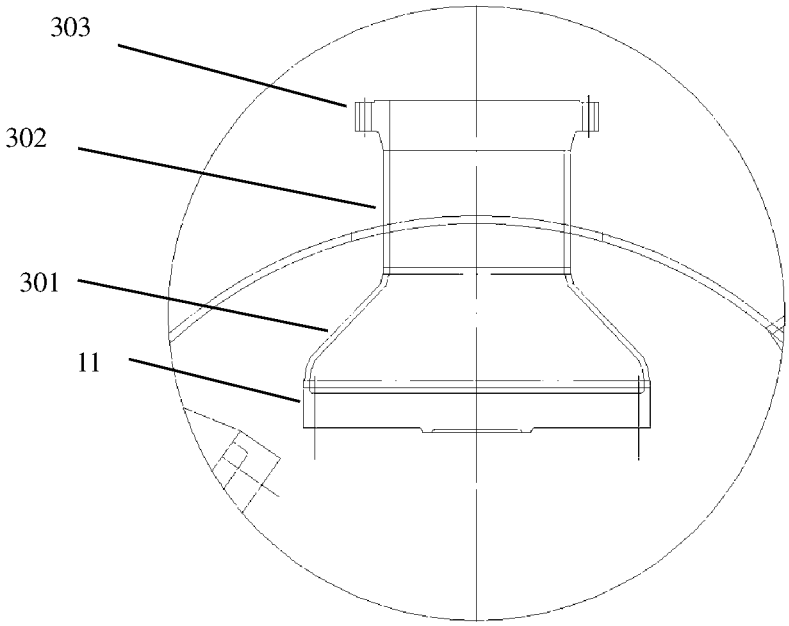
FIG. 2 is an enlarged view of position A of the tube sheet built-in type structure in the present utility model.
Figure 3:
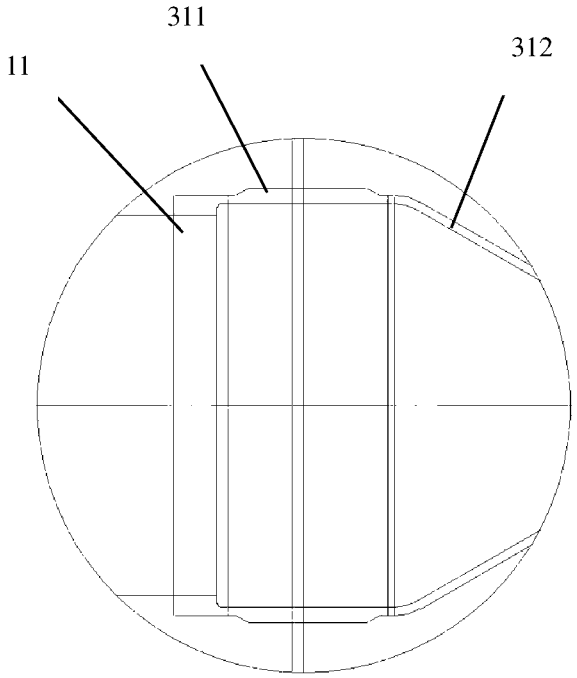
FIG. 3 is an enlarged view of position B of the tube sheet built-in type structure in the present utility model.
Figure 4:
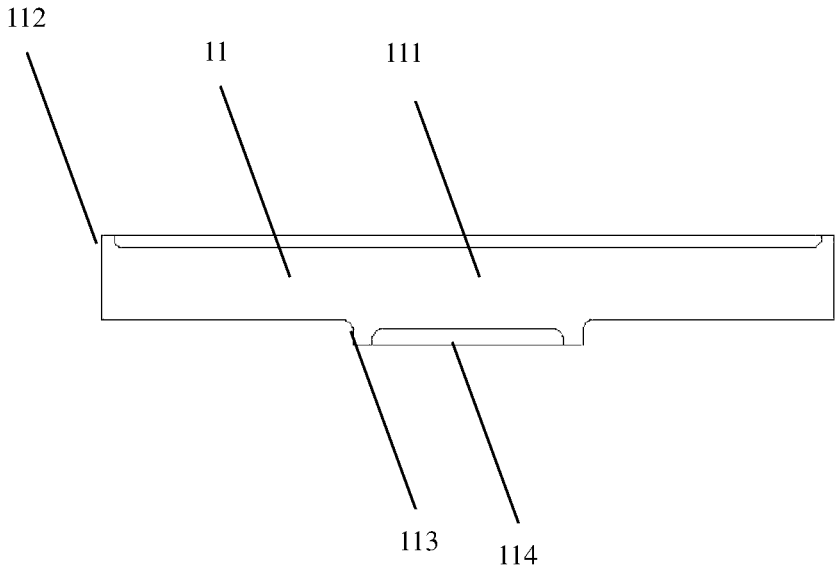
FIG. 4 is a schematic diagram of the tube sheet of the tube sheet built-in type structure in the present utility model.
Figure 5:
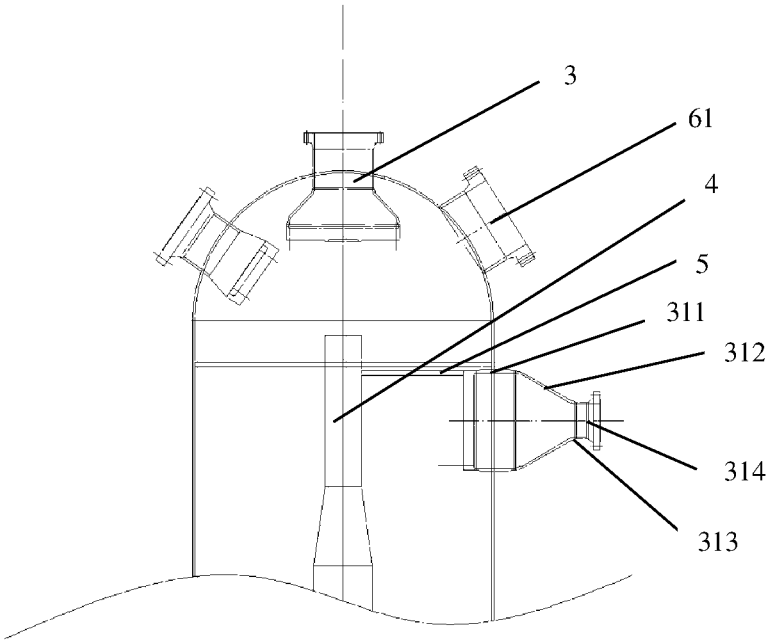
FIG. 5 is a schematic diagram of the supporting rod of the tube sheet built-in type structure in the present utility model.
Figure 6:
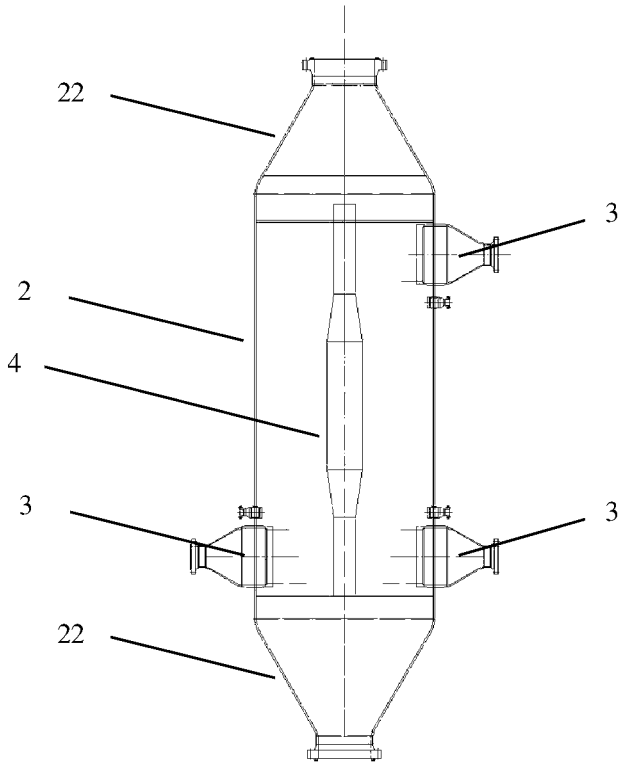
FIG. 6 is a schematic diagram of the lateral tubular structure of the tube sheet built-in type structure in the present utility model.
Figure 7:
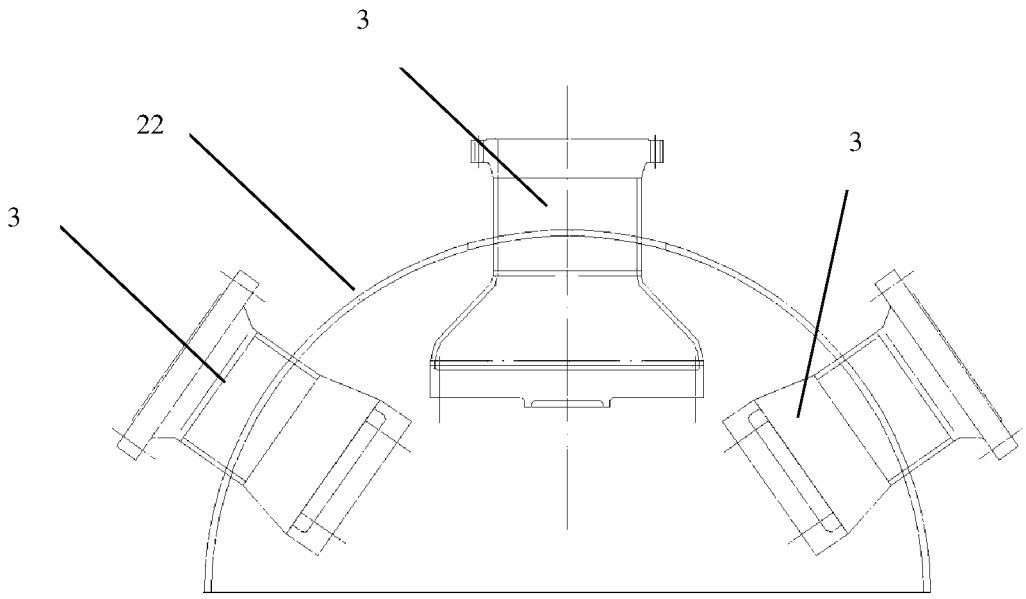
FIG. 7 is a schematic diagram of a plurality of tubular structures of the tube sheet built-in type structure in the present utility model.

FIG. 1 is a schematic diagram of the tube sheet built-in type structure in the present utility model, FIG. 2 is an enlarged view of position A of the tube sheet built-in type structure in the present utility model, FIG. 3 is an enlarged view of position B of the tube sheet built-in type structure in the present utility model, FIG. 4 is a schematic diagram of the tube sheet of the tube sheet built-in type structure in the present utility model, FIG. 5 is a schematic diagram of the supporting rod of the tube sheet built-in type structure in the present utility model, FIG. 6 is a schematic diagram of the lateral tubular structure of the tube sheet built-in type structure in the present utility model, and FIG. 7 is a schematic diagram of a plurality of tubular structures of the tube sheet built-in type structure in the present utility model. As shown in FIGS. 1 to 7, an exemplary embodiment of the tube sheet built-in type structure is disclosed, which is suitable for a heat exchanger, the heat exchanger includes a housing, comprising: a tube sheet 11, the tube sheet 11 is provided inside the housing 2 and is not in direct contact with the housing 2. With the above setting the tube sheet 11 is hidden inside the housing 2, as the tube sheet 11 is provided inside the housing 2, the overall longitudinal length of the device is reduced. The tube sheet 11 is indirectly connected to the heads of the housing 2 through short portion and/or connecting tubes. Therefore, the area occupied by the short portions and/or connecting tubes on the heads is smaller, resulting in smaller openings sizes of the heads, which is more conducive to hole reinforcement and material saving.

Furthermore, as a preferred embodiment, the tube sheet 11 comprises: a plate-shaped structure 111 and a first annular structure 112 integrally set on the outer edge of the plate-shaped structure 111, wherein the first annular structure 112 is provided on one side of the plate-shaped structure 111.

Furthermore, as a preferred embodiment, the tube sheet 11 comprises: a second annular structure 113 integrally set in the middle of the plate-shaped structure 111, wherein the second annular structure 113 is provided on other side of the plate-shaped structure 111, and the interior of the second annular structure 113 forms a groove 114, wherein a distance between an end of the second annular structure 113 and an bottom of the groove 114 is smaller than a distance between the end of the second annular structure 113 and the plate-shaped structure 114.

Furthermore, as a preferred embodiment, the tube sheet built-in type structure comprises: a tubular structure 3 that passes through the housing 2, wherein one end of the tubular structure 3 is located outside the housing 2, and other end of the tubular structure 3 is located inside the housing 2 and connected to the tube sheet 11.

Additionally, as a preferred embodiment, the tubular structure 3 includes: a conical portion 301 connected to the tube sheet 11, a straight portion 302 connected to the conical portion 301, and a joint 303 connected to the straight portion 302, wherein an end of the conical portion 301 which has a larger inner diameter is connected to the tube sheet 11, and an end of the conical portion 301 which has a smaller inner diameter is connected to the straight portion 302.

Furthermore, as a preferred embodiment, at least a part of the straight portion 302 is located outside the housing 2, and at least a part of the straight portion 302 is located inside the housing 2.

Furthermore, as another v, an outer circumference of the straight portion 302 is fixedly connected to the housing 2.

Additionally, as a preferred embodiment, the tubular structure 3 comprises a first straight portion 311 connected to the tube sheet 11, a conical portion 312 connected to the first straight portion 311, a second straight portion 313 connected to the conical portion 312, and a joint 314 connected to the second straight portion 313, wherein an inner diameter of the first straight portion 311 is larger than an inner diameter of the second straight portion 313.

Furthermore, as a preferred embodiment, at least a part of the first straight portion 311 is located outside the housing 2, and at least a part of the first straight portion 311 is located inside the housing 2.

Furthermore, as a preferred embodiment, the outer circumference of the first straight portion 311 is fixedly connected to the housing 2.

Furthermore, as a preferred embodiment, the inner diameter of the first straight portion 311 is constant, and the outer diameter of the first straight portion 311 is variable.

Furthermore, as a preferred embodiment, the outer diameter of the middle of the first straight portion 311 is larger than the outer diameter of the two ends of the first straight portion 311.

Furthermore, as a preferred embodiment, the middle of the outer surface of the first straight portion 311 is connected to the two ends of the outer surface of the first straight portion 311 through a conical portion 312.

Furthermore, as a preferred embodiment, the heat exchanger has a central cylinder 4, the tube sheet 11 is perpendicular to an axis of the central cylinder 4, or the tube sheet 11 is parallel to the axis of the central cylinder 4, or there is an angle between the tube sheet 11 and the axis of the central cylinder 4.

Furthermore, as a preferred embodiment, the tube sheet in-built type structure further comprises: a supporting rod 5, one end of the supporting rod 5 is fixedly connected to the tube sheet 11, and other end of the supporting rod 5 is fixedly arranged. The support rod 5 is preferably a rigid supporting rod, allowing for small elastic deformation of the supporting rod 5.

Furthermore, as another preferred embodiment, the tube sheet in-built type structure further comprises: a supporting rod 5, one end of the supporting rod 5 is rotatably connected to the tube sheet 11, and other end of the supporting rod 5 is movable only in a first direction parallel to a plane in which the tube sheet 11 is located.

Furthermore, as another preferred embodiment, the tube sheet in-built type structure further comprises: a supporting rod 5, one end of the supporting rod 5 is rotatably connected to the tube sheet 11, and other end of the supporting rod 5 is movable only in a second direction orthogonal to a plane in which the tube sheet 11 is located.

Furthermore, as another preferred embodiment, the heat exchanger comprises a central cylinder 4, wherein the tube sheet 11 is parallel to an axis of the central cylinder 4, one end of the supporting rod 5 is rotatably connected to the tube sheet 11, and other end of the supporting rod 5 is slidably connected to the central cylinder 4, so that the other end of the supporting rod 5 is slidable along the outer surface of the central cylinder 4.

The above is only the preferred embodiment of the present utility model, and is not intended to limit the implementation and protection scope of the present utility model.

The present utility model further includes the following various embodiments of heat exchangers:

First preferred embodiment of the heat exchanger:

in the first preferred embodiment of the heat exchanger of the present utility model, the heat exchanger comprises a housing 2, the housing 2 includes a cylinder 21 and heads 22 respectively provided at the upper and lower ends of the cylinder 21.

In the first preferred embodiment of the heat exchanger of the present utility model, the heat exchanger further comprises a tube sheet 11, which is located inside the housing 2 and positioned at the upper part of the housing 2.

In the first preferred embodiment of the heat exchanger of the present utility model, a tubular structure 3 passes through the housing 2, one end of the tubular structure 3 is located outside the housing 2, other end of the tubular structure 3 is located inside the housing 2 and is connected to the tube sheet 11.

In the first preferred embodiment of the heat exchanger of the present utility model, the tubular structure 3 comprises: a conical portion 301 connected to the tube sheet 11, a straight portion 302 connected to the conical portion 301, and a joint 303 connected to the straight portion 302. An end of the conical portion 301 which has a larger inner diameter is connected to the tube sheet 11, and an end of the conical portion 301 which has a smaller inner diameter is connected to the straight portion 302.

In the first preferred embodiment of the heat exchanger of the present utility model, the upper part of the straight portion 302 is located outside the housing 2, while the lower part of the straight portion 302 is located inside the housing 2.

In the first preferred embodiment of the heat exchanger of the present utility model, the outer circumference of the straight portion 302 is fixedly connected to the housing 2.

In the first preferred embodiment of the heat exchanger of the present utility model, the heat exchanger further comprises a second tube sheet (not shown in the figure), which is located at the lower end of the housing 2, and the outer circumference of the second tube sheet is fixedly connected to the head 22.

In the first preferred embodiment of the heat exchanger of the present utility model, the above-mentioned heat exchanger, a housing-side connection is provided on the head 22 at the upper end of the cylinder 21 (not shown in the figure), and another housing-side connection is provided on the side of the cylinder 21.

The second preferred embodiment of the heat exchanger is as follows.

In the second preferred embodiment of the heat exchanger of the present utility model, the heat exchanger comprises a housing 2, the housing 2 comprises a cylinder 21 and heads 22 respectively provided at the upper and lower ends of the cylinder 21.

In the second preferred embodiment of the heat exchanger of the present utility model, the heat exchanger further comprises a tube sheet 11, the tube sheet 11 is located inside the housing 2 and positioned at the upper part of the housing 2, the tube sheet 11 is arranged in a horizontal manner.

In the second preferred embodiment of the heat exchanger of the present utility model, the heat exchanger further comprises: an upper tubular structure, the upper tubular structure comprises an upper conical portion connected to the upper tube sheet, an upper straight portion connected to the upper conical portion, and an upper joint connected to the upper straight portion. An end of the upper conical portion which has a larger inner diameter is connected to the upper tube sheet, while an end of the upper conical portion which has a smaller inner diameter is connected to the upper straight portion. At least a part of the upper straight portion is located outside the housing, while at least a part of the upper straight portion is located inside the housing. The outer circumference of the upper straight portion is fixedly connected to the head at the upper end of the cylinder.

In the second preferred embodiment of the heat exchanger of the present utility model, the heat exchanger further comprises: a side tube sheet, the side tube sheet is located inside the housing and positioned at the lower part of the housing, the side tube sheet is arranged in a vertical manner.

In the second preferred embodiment of the heat exchanger of the present utility model, the heat exchanger further comprises: a side tubular structure, wherein the side tubular structure comprises: a side first straight portion connected to a side tube sheet, a side conical portion connected to the side first straight portion, a side second straight portion connected to the side conical portion, and a side joint connected to the side second straight portion, wherein the inner diameter of the side first straight portion is larger than the inner diameter of the side second straight portion; at least a part of the side first straight portion is located outside the cylinder, and at least a part of the side first straight portion is located inside the cylinder; the outer circumference of the side first straight portion is fixedly connected to the cylinder.

In the second preferred embodiment of the heat exchanger of the present utility model, one side of the head 22 of the upper end of the cylinder 21 is provided with a first housing-side connection 61, and the middle of the head 22 of the lower end of the cylinder 21 is provided with a second housing-side connection 62.

The third preferred embodiment of the heat exchanger is as follows.

In the third preferred embodiment of the heat exchanger of the present utility model, the upper and lower ends of the heat exchanger both adopt the above-mentioned tube sheet built-in type structure, and at least one or two of the housing-side interfaces are located at the head of the housing of the heat exchanger, i.e., the housing-side connection is located on one side of the straight portion 302 of the tube sheet built-in type structure.

Alternatively, the upper and lower ends of the heat exchanger both adopt the above-mentioned tube sheet built-in type structure, and the housing-side interfaces are located on the cylinder of the housing of the heat exchanger.

The fourth preferred embodiment of the heat exchanger is as follows.

In the fourth preferred embodiment of the heat exchanger of the present utility model, one of the upper and lower ends of the heat exchanger adopts the above-mentioned tube sheet built-in type structure, and one or more of the tube sheet built-in type structures are adopted on the side of the heat exchanger's cylinder. One of the housing-side connections is located at the head of the heat exchanger's housing, and the other housing-side connection is located in the middle of the head at the lower end of the heat exchanger's housing.

The above description is only the preferred embodiment of the present utility model, and it does not limit the implementation and protection scope of the present utility model. Those skilled in the art should be aware that any alternative substitutions and obvious modifications made based on the content of this utility model specification and drawings should be included within the protection scope of the present utility model.

What is claimed is:

1. A tube sheet built-in type structure suitable for a heat exchanger, the heat exchanger comprises a housing, wherein, the tube sheet built-in type structure comprising a tube sheet, the tube sheet is provided inside the housing and is not in direct contact with the housing, wherein the tube sheet comprising: a plate-shaped structure and a first annular structure integrally set on the outer edge of the plate-shaped structure, and wherein the first annular structure is provided on one side of the plate-shaped structure.

2. The tube sheet built-in type structure of claim 1, comprising: a tubular structure that passes through the housing, one end of the tubular structure is located outside the housing, and other end of the tubular structure is located inside the housing and connected to the tube sheet.

3. The tube sheet built-in type structure of claim 2, wherein the tubular structure comprises: a conical portion connected to the tube sheet, a straight portion connected to the conical portion, and a joint connected to the straight portion, an end of the conical portion which has a larger inner diameter is connected to the tube sheet, and an end of the conical portion which has a smaller inner diameter is connected to the straight portion.

4. The tube sheet built-in type structure of claim 2, wherein the tubular structure comprises: a first straight portion connected to the tube sheet, a conical portion connected to the first straight portion, a second straight portion connected to the conical portion, and a joint connected to the second straight portion, wherein an inner diameter of the first straight portion is larger than an inner diameter of the second straight portion.

5. The tube sheet built-in type structure of claim 4, wherein, the inner diameter of the first straight portion is constant, and the outer diameter of the first straight portion is variable.

6. The tube sheet built-in type structure of claim 1, wherein the heat exchanger has a central cylinder, the tube sheet is perpendicular to an axis of the central cylinder, or the tube sheet is parallel to the axis of the central cylinder, or there is an angle between the tube sheet and the axis of the central cylinder.

7. A spiral-flow type wound tube heat exchanger, comprises one or more of the tube sheet in-built type structures as claimed in claim 1.

* * * * *